United States Patent [19]

Proudfoot

[11] 4,319,661

[45] Mar. 16, 1982

[54] ACOUSTIC SPACE ABSORBER UNIT

[75] Inventor: Don A. Proudfoot, Greenwich, Conn.

[73] Assignee: The Proudfoot Company, Inc., Greenwich, Conn.

[21] Appl. No.: 117,997

[22] Filed: Feb. 4, 1980

Related U.S. Application Data

[63] Continuation of Ser. No. 944,146, Sep. 20, 1978, abandoned.

[51] Int. Cl.[3] ..... E04B 1/82

[52] U.S. Cl. ..... 181/295; 181/286

[58] Field of Search ..... 181/30, 210, 285, 286, 181/288–293, 295

[56] References Cited

U.S. PATENT DOCUMENTS

| | | | |
|---|---|---|---|
| 1,554,179 | 9/1925 | Trader | 181/293 |
| 2,502,020 | 3/1950 | Olson | 181/295 |
| 2,840,179 | 6/1958 | Junger | 181/286 |
| 3,095,943 | 7/1963 | Kemp | 181/292 |
| 3,229,785 | 1/1966 | Pottash | 181/290 |
| 3,769,767 | 11/1973 | Scott | 181/288 X |
| 3,819,007 | 6/1974 | Wirk et al. | 181/286 |
| 3,910,374 | 10/1975 | Holehouse | 181/292 |
| 4,084,366 | 4/1978 | Saylor et al. | 181/292 X |
| 4,174,020 | 11/1979 | Challis | 181/286 X |

*Primary Examiner*—L. T. Hix
*Assistant Examiner*—Benjamin R. Fuller
*Attorney, Agent, or Firm*—William W. Glenny

[57] ABSTRACT

An acoustic space absorber unit is provided in which Helmholtz resonators are mounted within an enclosure composed of sound absorbing material, with the orifices of the resonators near to but spaced from the enclosing material. The Helmholtz resonators are tuned to low audible frequencies such as 125 Hz. The Helmholtz resonators enhance the sound absorption at low frequencies while the entire unit provides sound absorption throughout the entire audible range.

16 Claims, 3 Drawing Figures

ACOUSTIC SPACE ABSORBER UNIT

CROSS REFERENCES TO RELATED APPLICATIONS

This is a continuation of application Ser. No. 944,146, filed Sept. 20, 1978, now abandoned.

The desirability of using Helmholtz resonators to enhance acoustic effects has been recognized since ancient times. The ancient Romans employed amphorae in open air theaters to increase reverberation times and such resonators have been used in closed rooms since early times to reduce the noise level and reverberation times at the resonant frequency. Junger, M.C. "Comments on 'Review of Acoustics-Historical and Philosophical Development, R. B. Lindsay, Ed.' [V. O. Knudsen, J. Acoust. Soc. Am. 55, 685 (1974)]", p. 691, J. Acoust. Soc. Am., Vol. 56, No. 2, Aug. 1974.

More modernly, devices known as acoustic space absorbers have been employed for many years to reduce the noise in a room. In particular, they have been used especially in rooms occupied by people, but having a source of noise in one particular location. This applies, for example, to bowling alleys. In that case, the acoustic space absorbers have been mounted in locations adjacent the pins where excessive noise originates. They have also been used in machine shops and restaurants, and offices to reduce background noise to which workers and visitors are exposed. And they have been used in pump rooms and compressor rooms to reduce noise from such sources. Generally, such acoustic space absorbers have consisted of large sheets of sound absorbing material and in some cases other large bodies of sound absorbing material sandwiched between porous walls. Such a structure is illustrated in Bedell et al U.S. Pat. No. 2,160,638.

In the past, sound absorption has also been achieved by locating sound absorbing material or sound absorbers of various kinds on the walls of rooms. Some of the latter devices have been in the form of Helmholtz resonators. Examples of such structures are found in Zaldastani and Junger U.S. Pat. No. 2,933,146, Junger U.S. Pat. No. 3,506,089, Kleinschmidt U.S. Pat. No. 3,837,426, and Kleinschmidt and Proudfoot (David Proudfoot) U.S. Pat. No. 3,866,001.

A prior art device which has been used both for mounting in the wall and in the space of a room remote from the wall, is described in Grue U.S. Pat. No. 2,610,695. Grue states that an apertured porous material consists of many small Helmholtz resonators. Based upon his statements, it could be argued that his device consists of many Helmholtz resonators. Accordingly, it could be argued that Helmholtz resonators of some kind have previously been suspended in rooms to enhance the sound absorption. But all such "resonators" of the kind described by Grue are very small and have been tuned to a high frequency. But the so-called Helmholtz resonators described by Grue are not true Helmholtz resonators at all, since a Helmholtz resonator has substantially impermeable stiff walls that enclose a volume that is larger in cross section and volume than the cross sectional and volume of the orifice.

Grue and Bedell et al space absorbers have been only weakly absorbent at frequencies in the low frequency, audible or audio range, such as below 250 Hz. (As used herein, the term audible, or audio, range refers to the range of acoustic frequencies which may be heard by human beings.) And still there is a need for sound absorption in the low frequency audible, or audio, range as well as in other parts of the audible, or audio, range. The reason is that a great deal of noise occurs at low frequencies below about 250 Hz and space absorbers currently in use have little effect at such low frequencies.

The object of the present invention is to provide an improved acoustic space absorber unit that has enhanced absorbing efficiency in the low frequency range as well as high sound absorbing efficiency at higher acoustic frequencies.

In the embodiment of the invention described in detail herein, the main object of this invention is accomplished by providing a compound sound absorbing unit which comprises a cylindrical member with sound absorbing material on the external surface thereof and one or more Helmholtz resonators enclosed at the ends thereof with the resonator orifices on the outer side or sides thereof. In another embodiment of the invention that has been contemplated, two Helmholtz resonators are deployed within a cylindrical housing adjacent the surface thereof. Each of the resonators is tuned to a frequency in the lower end of the audible, or audio, spectrum.

THE DRAWINGS

The foregoing and other objects and aspects of the invention will be clear to those skilled in the art from a reading of the following description taken in connection with the accompanying drawings, wherein.

DESCRIPTION OF THE INVENTION

Figure 1:
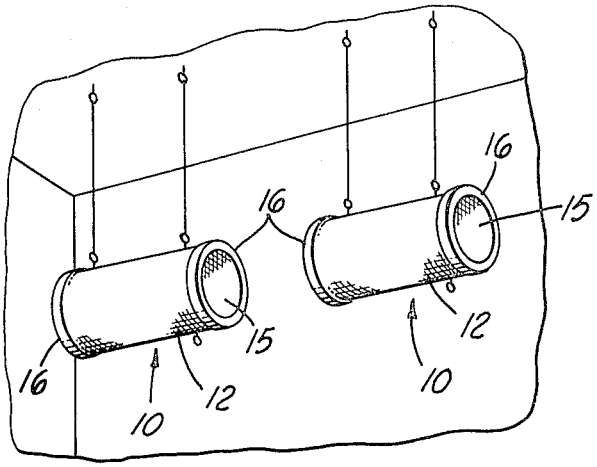
FIG. 1 is a perspective view of a room in which two acoustic absorbers employing this invention are shown horizontally suspended in a room.
Figure 2:
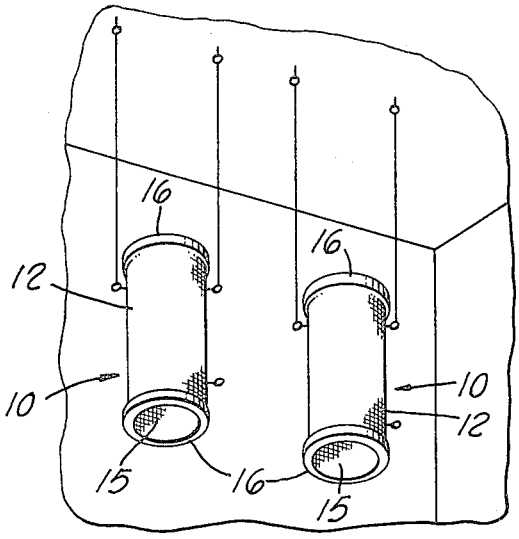
FIG. 2 is a perspective view of a room in which two such acoustic absorbers are shown suspended vertically in a room.
Figure 3:
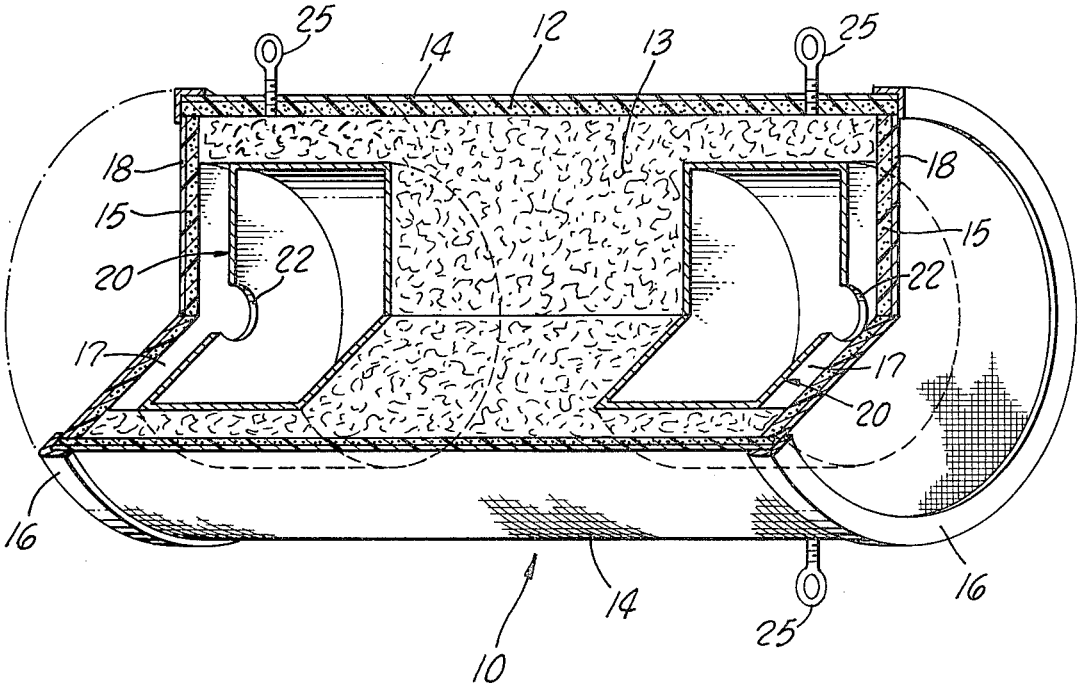
FIG. 3 is a partially broken-away perspective view of an acoustic space absorber embodying features of this invention.

An acoustic space absorber, embodying features of the invention as illustrated in FIG. 3, may be suspended horizontally or vertically in a room in which the noise level is to be reduced, as indicated in FIGS. 1 and 2. In practice, the space absorbers 10 are mounted in a room adjacent the source of noise, such as noisy machinery in a machine shop or such as the pins in a bowling alley, so as to reduce the noise level in the room. Thus, by mounting the space absorber units close to the noise sources, conversations may be conducted more readily at any point in the room, especially at points remote from the source of the noise. Also the tendency of the noise levels to produce hearing impairments is reduced as, below a certain noise level, such impairment effects do not occur.

As indicated in FIG. 3, the embodiment of the space absorber 10 illustrated is of circular cylindrical configuration having a length considerably greater than its diameter. It consists primarily of a cylindrical body or layer 12 of sound absorbing material and two Helmholtz resonators 20 mounted within that cylindrical layer 12 with the resonator orifices 22 exposed to ambient sound. In practice, porous end caps or cover discs 15 conceal the orifices, but provide access for sound to reach the orifices through end spaces 17. Thus, both the container wall comprising the outer layer 12 of sound absorbing material and the end caps 15 and the resonator orifices are exposed to the ambient noise that may exist in the space surrounding the absorber.

In the best embodiment of the invention, a body 13 of sound absorbent material fills the cylindrical space within the absorbing layer 12 and between the two Helmholtz resonators. But the resonators 20 are empty. The Helmholtz resonators are tuned to a low audible frequency, such as 125 Hz, within a range in which a large portion of mechanical noise, such as noise from blowers, pumps, etc., commonly occurs.

The cylindrical body 12 of sound absorbing material is covered by means of a fiberglass scrim or cover 14. Flat screens 18 composed of such scrim material also cover the outer surfaces of the caps 15. Other covers (scrims), such as fiberglass cloth, vinyl, and thin Mylar (plastic film) might also be used for specialized purposes, i.e., color, appearance, cleanliness, etc. The cylindrical body 12 is in direct contact with the internal body 13. But the discs are spaced from the orificed ends of the Helmholtz resonators to form the spaces 17. The cap members 15 not only close the ends of the cylindrical body, but also aid the action of the resonators 20. The spaces 17 have larger diameters than the orifices, so that the particle velocity of the vibrating air is greater in the orifice than at the discs 15. The various parts are cemented together by means of suitable adhesive and are rigidly held together by end rings 16.

Usually, an array of such space absorbers is suspended in a room adjacent a source of noise, the effects of which are to be reduced. The individual absorber units 10 of the array are spaced apart between 2 and 6 feet between centers. When such absorbers are mounted in an array of a given size, the total absorption produced by the array increases as the spacing is reduced. On the other hand, the absorption per absorber unit decreases as the spacing between the units decreases.

All the components are substantially non-combustible. The total weight per absorber unit of the specific embodiments of the invention described is approximately 6 pounds, thus minimizing any danger from the increased load that the absorbers might produce on the ceiling from which the absorbers are suspended.

The cylindrical sound absorbing layer 12 is made of an incombustible fibrous material, such as molded fiberglass. The central body 13 of sound absorbing material is composed of fiberglass or mineral wool. Fiberglass having a density of 1 to 2 lbs/cu.ft. and mineral wool having a density of 3 to 4 lbs/cu.ft. are suitable. The cover 12 and the discs 15 are composed of molded fiberglass material. This fiberglass material has a density of 4 to 8 lbs/cu.ft. The screens are composed of approximately 0.0006" fibers and have a mesh of approximately 1/16"×1/16".

The cover 14 and the cylindrical casing 12 and the end discs 15 are porous and are highly transparent to sound over the entire audible range, particularly below about 250 Hz.

When an absorber 10 is suspended in a room, noise in the surrounding space is absorbed both by the bodies 12 and 13 of absorbing material and by the Helmholtz resonators 20. The Helmholtz resonators 20 serve to enhance the absorption at low audible frequencies.

Thus, the invention provides an absorber and an array of absorbers that is effective over a wide range of audible frequencies.

Typical absorbers which have been used successfully have an overall length of about 24" and an outside diameter of 12". The Helmholtz resonators were in the form of metal containers composed of wall material having a thickness of 0.0095". The outside diameters of the resonators were 7½" and the overall heights are 6⅛". The volumes of the two resonators were approximately 265 cu.in. and the diameters of the orifices were approximately ≃". Such a resonator has a resonant frequency of about 125 Hz when measured as a unit separate and apart from the remainder of the absorber. The methods for calculating resonant frequency of a Helmholtz resonator are well known. For example, they are described in a paper titled "On the Theory and Design of Acoustic Resonators" by Uno Ingard (JASA 25, pp. 1037ff, Nov. 1953). The calculations are readily confirmed by measurements. More difficult to calculate are the resistance, or viscous, properties that contribute to the absorption of energy from sound that passes through the orifice to or from the cavity of the resonator.

The cylindrical layer 12 has a radial thickness of about 0.5", and the discs 16 have a thickness of about ½". The aluminum rings are of L-shape in cross section with an axial dimension of ¾" and a radial dimension of ½" and a thickness of 1/32".

Helmholtz resonators may be made with several orifices and with orifices that have flared edges or tubular necks on them. A single plain hole is employed as the orifice of this invention in order to achieve high dynamic resistance and low resonant frequency. The use of a single hole instead of two holes of equal open area reduces the resonant frequency by about 10% and increases the acoustic radiation resistance by almost 100%.

The mounting of the two Helmholtz resonators in the cylindrical absorbing wall, affects the overall absorption spectrum of the unit in a manner which is predictable only in a general way.

The absorption coefficients of a space absorber described have been measured in accordance with the standard method of testing described in the ASTM Bulletin, designated C-423-66, as revised up to April 1969.

More particularly, to measure the absorption coefficients, nine absorber units were mounted in a room in a substantially rectangular array on 4-foot centers. The absorption per absorber unit at various frequencies, was found to be

| Mid-hand Frequency - Hertz | 100 | 125 | 160 | 250 | 500 | 1000 | 2000 | 4000 |
|---|---|---|---|---|---|---|---|---|
| Sabins per Absorber Unit | 3.88 | 3.65 | 4.80 | 5.84 | 8.48 | 9.51 | 9.98 | 9.90 |

The noise reduction coefficient (NRC) of this unit was 8.45, calculated in standard fashion. It is to be noted that the absorption at 100 Hz is extraordinarily high. This can be seen by noting that the absorption coefficient in Sabins per absorber unit decreases monotonically below 2000 Hz and almost linearly below 500 Hz at the measured frequency when viewed on an octave scale. Though the Helmholtz resonators had a resonant frequency of about 125 Hz when measured apart from the sound absorber, the interaction between the resonators and the remaining parts of the absorber were such that the absorption was abnormally high at the lower end of the frequency range.

Screw eyes 25 are mounted in the side walls of the units as needed, for hanging the unit either horizontally or vertically as illustrated in FIGS. 1 and 2.

It is thus seen that this invention provides an acoustic space absorber which has excellent sound absorption qualities throughout the entire audible range, together with improved acoustic absorption qualities in the low audible range.

The invention may be embodied in many other forms than that described herein. For example, the sound absorber need not be of circular cylindrical shape with flat ends. It may have a square or rectangular cross section. And it may be spherical. Other sound absorbing material may be used in place of fiberglass.

Furthermore, the resonators may have multiple orifices or orifices with flared edges or orifices in the form of tubular necks to meet the requirements of special applications.

It is therefore to be understood that the invention is not limited to the specific embodiments described, but may be embodied in many other forms within the scope of the appended claims.

The invention claimed is:

1. An acoustic space absorber comprising in combination:

an elongated cylindrical body of sound absorbing material;

a Helmholtz resonator within said body adjacent to one end thereof comprising a wall member of stiff substantially impermeable material forming a cavity and having orifice means having an isolated orifice structure in said wall member, said orifice means establishing acoustic communication between said cavity and the space external to said body, said isolated orifice structure being surrounded by a substantial portion of said impermeable wall member, said portion of said wall member having an outwardly facing area many times in excess of the cross-sectional area of said orifice structure, whereby acoustic waves external to said body force air into and from said cavity substantially entirely through said orifice structure;

and a second such Helmholtz resonator within said body adjacent to the opposite end thereof.

2. In a space absorber as defined in claim 1, a cylindrical sound-transparent casing enclosing said cylindrical body of sound absorbing material and sound transparent cap members closing the ends thereof on the external sides of said resonators.

3. In a space absorber as defined in claim 2, wherein the orificed ends of said resonators are spaced from said cap members.

4. In a space absorber as specified in claim 1, wherein said Helmholtz resonators are in the form of cylindrical containers each with a disc closing one end and an orificed disc at the other end, said containers and said cylindrical body being coaxial.

5. In a space absorber as defined in claim 4, wherein said orificed discs are at the outer ends of said containers.

6. A sound absorber as specified in claim 5, wherein said resonators are resonant at a frequency of about 125 hz.

7. A sound absorber as defined in claim 1 wherein such resonators are separated along the axis of said cylindrical body of sound absorbing material by a distance greater than the length of either along said axis.

8. A sound absorber as defined in claim 7 wherein the space between said Helmholtz resonators contains sound absorbing material.

9. A sound absorber as defined in claim 1, comprising eyes extending outwardly therefrom to facilitate hanging of the absorber from a ceiling.

10. An acoustic space absorber comprising:

a body of sound absorbing material;

a Helmholtz resonator within said body comprising a wall member of stiff substantially impermeable material forming a cavity and having orifice means having an isolated orifice structure in said wall member, said orifice means establishing acoustic communication between said cavity and the space external to said body, said isolated orifice structure being surrounded by a front portion of said impermeable wall member, said front portion of said wall member having an outwardly facing area many times in excess of the cross-sectional area of said orifice structure, whereby acoustic waves external to said body force air into and from said cavity substantially entirely through said orifice structure;

and a second such Helmholtz resonator within said body, the orifices of the two resonators being generally oppositely directed.

11. The invention as defined in claim 10 wherein said resonators are in the form of cylindrical containers each with a disc closing its rear end and an orificed disc at the opposite end constituting said wall member front portion.

12. The invention as defined in claim 11 wherein said cylindrical containers are coaxial.

13. The invention as defined in claim 12 wherein said container rear ends are substantially spaced from one another.

14. The invention as defined in claim 13 wherein the space between said rear ends contains sound absorbing material.

15. The invention as defined in claim 10 wherein said resonators are substantially spaced from one another.

16. The invention as defined in claim 15 wherein the space between said resonators contains sound absorbing material.

* * * * *